US005419001A

United States Patent [19]

Wan

[11] Patent Number: 5,419,001

[45] Date of Patent: May 30, 1995

[54] TOOTHBRUSH

[76] Inventor: John C. Wan, 1600 S. Joyce St. Apt. B-701, Arlington, Va. 22202

[21] Appl. No.: 219,260

[22] Filed: Mar. 29, 1994

[51] Int. Cl.[6] ..... A46B 9/04

[52] U.S. Cl. ..... 15/167.1; 15/DIG. 5

[58] Field of Search ..... 15/167.1, 167.2, DIG. 5; D4/104

[56] References Cited

U.S. PATENT DOCUMENTS

| | | | |
|---|---|---|---|
| D. 52,385 | 9/1918 | Clapp . | |
| D. 200,395 | 2/1965 | Brennesholtz . | |
| D. 219,121 | 11/1970 | Krahner . | |
| D. 238,834 | 2/1976 | Hjelle . | |
| D. 272,684 | 2/1984 | Stocchi . | |
| D. 309,528 | 7/1990 | Valenti | D4/104 |
| D. 317,529 | 6/1991 | Smigel et al. | D4/104 |
| 560,663 | 5/1896 | Wallas | 15/167.1 |
| 2,274,042 | 2/1942 | Cosby | 15/167.1 |
| 2,849,740 | 9/1958 | Pauker | 15/167.1 |
| 3,152,349 | 10/1964 | Brennesholtz | 15/167.1 |
| 3,188,673 | 6/1965 | Newman | 15/167.1 |
| 3,263,258 | 8/1966 | Burge | 15/167.1 |
| 3,742,549 | 7/1973 | Scopp et al. | 15/167.1 |
| 4,033,008 | 7/1977 | Warren et al. | 15/167.1 |
| 4,356,585 | 11/1982 | Protell et al. | 15/111 |
| 4,472,853 | 9/1984 | Rauch | 15/167.1 |
| 4,519,111 | 5/1985 | Cavazza | 15/167.1 |
| 4,724,570 | 2/1988 | Hitzman | 15/167.1 |
| 5,201,092 | 4/1993 | Colson | 15/DIG. 5 |

FOREIGN PATENT DOCUMENTS

| | | | |
|---|---|---|---|
| 2558355 | 7/1985 | France . | |
| 2561082 | 9/1985 | France . | |
| 1226531 | 10/1966 | Germany . | |
| 3528596 | 2/1987 | Germany | 15/167.1 |
| 355452 | 2/1938 | Italy | 15/167.1 |
| 664271 | 2/1988 | Switzerland . | |
| 672052 | 10/1989 | Switzerland | 15/167.1 |

*Primary Examiner*—Mark Spisich
*Attorney, Agent, or Firm*—Staas & Halsey

[57] ABSTRACT

A toothbrush having the following combination of bristles: bristles that taper downward at the front of the toothbrush relative to the rear of the toothbrush, a central row of bristles that is the tallest and hardest, and side rows of bristles that are softer and shorter.

13 Claims, 2 Drawing Sheets

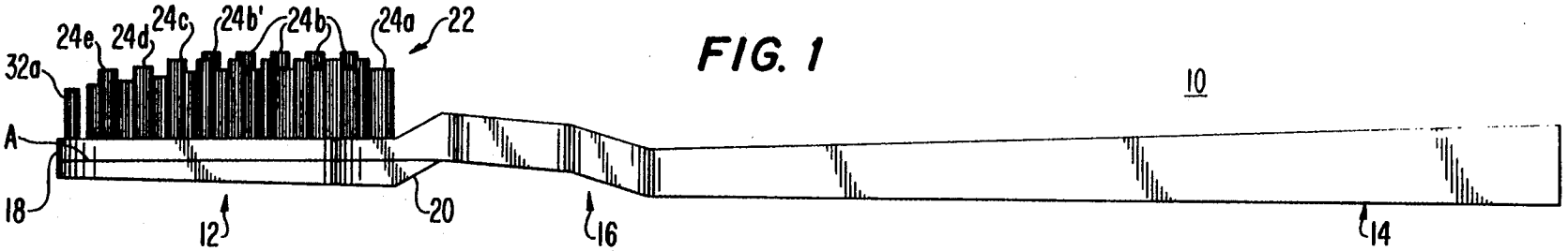
FIG. 1
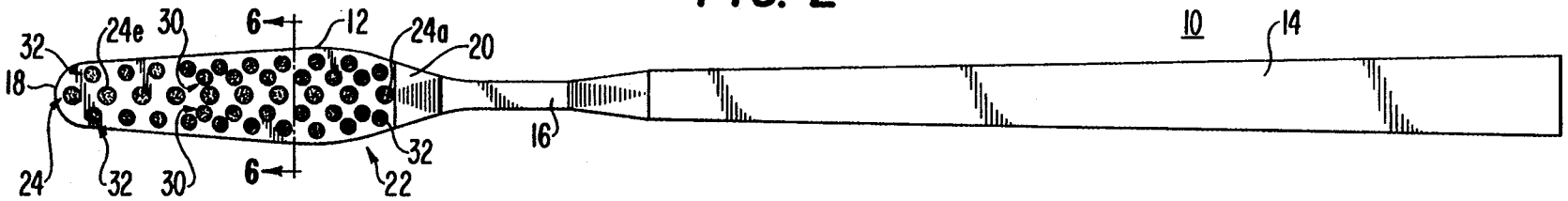
FIG. 2
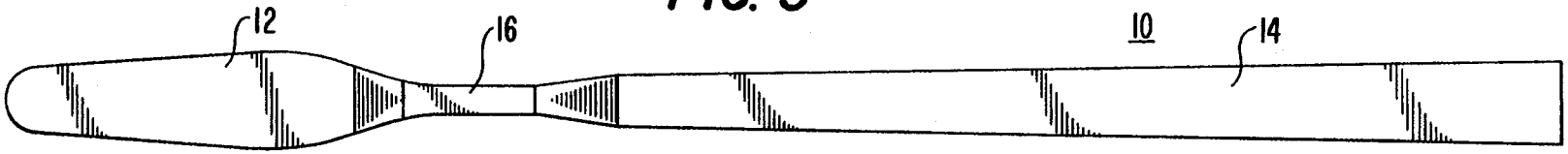
FIG. 3
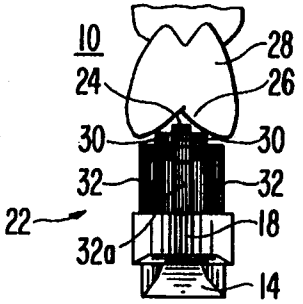
FIG. 6
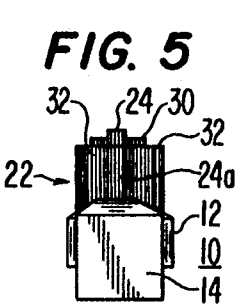
FIG. 5
FIG. 4

TOOTHBRUSH

BACKGROUND OF THE INVENTION

1. Field of the Invention

The present invention relates to a toothbrush and, more particularly, to a toothbrush with a bristle configuration that better cleans teeth.

2. Description of the Related Art

Many toothbrush designs are known, wherein the bristles are configured in many different ways, each design intending to better clean the teeth. In most cases, the bristles usually terminate in generally the same plane. Such a toothbrush, however, is not capable of effectively reaching the molars and wisdom teeth, while also maintaining good contact with the denture, for better cleansing action.

SUMMARY OF THE INVENTION

It is a purpose of the present invention to provide a toothbrush that cleans the teeth better than conventional toothbrushes.

It is another purpose of the present invention to provide a toothbrush that lasts longer than conventional toothbrushes.

It is another purpose of the present invention to provide a toothbrush that includes bristles at the front of the toothbrush that are configured to better reach molars and wisdom teeth.

It is another purpose of the present invention to provide a toothbrush that includes bristles at the rear of the toothbrush that are configured to better clean the denture.

It is another purpose of the present invention to provide a toothbrush that includes a central longitudinal row of bristles that is higher than remaining generally parallel, outer, supporting rows to provide better and longer lasting scrubbing action.

It is another purpose of the present invention to provide a toothbrush with a central row of bristles that conform better to the shape of the molars for better cleansing action.

It is another purpose of the present invention to provide a toothbrush having side rows of bristles that are shorter than a central row of bristles to provide massaging action to the gum, thereby lessening irritation and injuries to the gum and inside cheek.

It is another purpose of the present invention to provide a toothbrush having a higher central row of bristles than side rows, wherein the side rows are made of softer bristles than the central row, and will fray less than the conventional toothbrushes.

To achieve the forgoing and other purposes of the present invention, there is provided a toothbrush having the following combination of bristles: bristles that taper downward at the front of the toothbrush relative to the rear of the toothbrush, a central row of bristles extending longitudinally of the toothbrush head and which is the highest and hardest, and side rows of bristles that are generally parallel to the central row but are softer and shorter.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 1 is a side view of the toothbrush according to a preferred embodiment of the present invention.

FIG. 2 is a top view of the toothbrush according to the present invention.

FIG. 3 is a bottom view of the toothbrush according to the present invention.

FIG. 4 is a front view of the toothbrush according to the present invention.

FIG. 5 is a back view of the toothbrush according to the present invention.

FIG. 6 is a view along line 6—6 in FIG. 2.

DESCRIPTION OF THE PREFERRED EMBODIMENT

Figure 7:
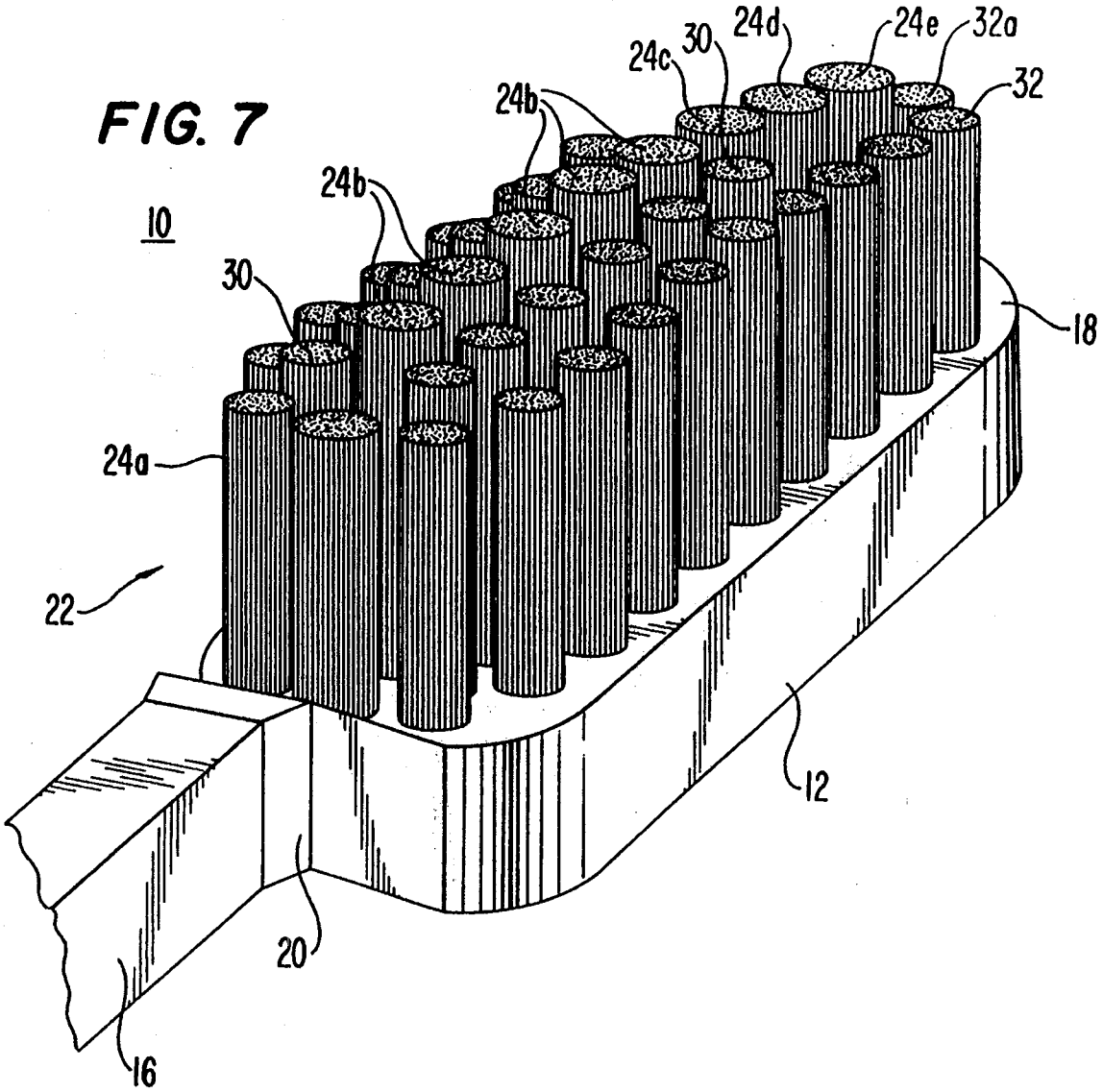
FIG. 7 is a perspective view of the toothbrush according to the present invention.

The preferred embodiment of the present invention will now be described in detail with reference to FIGS. 1–7.

While the preferred embodiment is described and shown as having a particular configuration, such as relative diameters, flat topped bristles, and orientation of the head, neck and handle, the invention is not so limited. The toothbrush according to the present invention does not have to look just like the toothbrush shown in the drawings. Instead, the claims will dictate the scope of the invention. Further, while certain measurements are provided, these are merely exemplary.

The preferred embodiment of the toothbrush according to the present invention shown in FIGS. 1–7 is generally denominated by reference numeral 10. This toothbrush 10 includes a front portion or head 12, a rear portion or handle 14 and a middle portion or neck 16 integrally connecting the head 12 and the handle 14.

The head 12 is generally planar and includes a first forward end 18 and a second rearward end 20. The head 12 is about 5–6 mm thick, about 8–14 mm wide and about 35–40 mm long. The head 12 also has a longitudinal axis "A" indicated in FIG. 1. Located between the ends 18, 20 of the head 12, embedded in the head 12, is a set of bristles 22.

As best seen in FIGS. 2, 4, 6 and 7, the set of bristles 22 includes a first plurality of bristles 24 in the form of a linear central row, a second plurality of bristles 30 in the form of a pair of outwardly oriented rows of bristles and a third plurality of bristles 32 in the form of an outermost periphery of bristles.

The first row 24 of bristles includes the largest diameter and highest bristles of the set of bristles 22. These bristles 24 are oriented linearly along the longitudinal axis "A" of the head 12. In this preferred embodiment, the number of the bristles 24 is nine, although there could be other numbers as desired.

The bristles 24 extend from the rear 20 to the front 18 of the head 12, and include one bristle **24*a* that is of the shortest height of the bristles 24 (and the same height as a majority of the third plurality of bristles 32 as described below), four bristles 24*b* that are of the same height, the greatest height of all the bristles 22, one bristle 24*b*' that is slightly shorter than the bristles 24*b*, two bristles 24*c*, 24*d*, which are of descending height between the height of the bristles 24***a* and 24*b*′, and a bristle 24*e* which is the height of the bristle 24*a*. The diameters however are generally the same.

For a frame of reference, the longest bristles 24*b* are approximately 11 mm high from the head 12.

The large diameter of the bristles 24 provides for longer bristle life and longer lasting scrubbing action. These bristles 24 also allow use of less hard and therefore less abrasive bristle material, while still achieving good scrubbing action.

The bristles 24 also conform better with the shape of the molars, thus providing better molar cleansing action. More particularly, the longer bristles 24, in comparison to the adjacent shorter bristles discussed below, are able to get into the recesses or crevasses 26 formed in the molar 28, as shown in FIG. 4.

As best shown in FIGS. 2 and 7, the two rows of bristles 30 are adjacent and generally parallel to the bristles 24*a*, 24*b* and 24*b*′. In the preferred embodiment, the number of bristles 30 in each row is six, although there could be other numbers as desired, and each is of the same height and generally of the same diameter. Each bristle's 30 height is less than bristles 24*b*′. The height of the bristles 30 is about 9.5 mm from the head 12.

The outermost bristles 32 extend from one side of the rearward end 20 of the head 12, to the forward end 18 of the head 12 and back to the other side of the rearward end 20 of the head 12. In the preferred embodiment, there are twenty-one of these bristles 32 with ten on each side, although there could be other numbers, and one as the forwardmost bristle 32*a*. These bristles 32 taper downward in height at forward end 18 of the head 12 as best shown in FIG. 4. The majority of the bristles 32 is the longest thereof at about 8 mm high from the head 12.

The bristles 30 and 32 have generally the same diameter, which is smaller than the diameter of the bristles 24.

The relatively shorter side bristles 30 and 32 offer massaging action to the gum, while lessening irritation and injuries to the gum and inside of the cheek. The shorter bristles 30, 32, also experience less fraying even if relatively soft bristle material is used, since they are not necessarily in contact with the teeth; the larger bristles 24 may be making the most contact. Also, the shorter bristles 30, 32 support and hold the longer inside bristles 24 better so there will be less fraying by the inside bristles 24. Less fraying results in less gum and cheek irritation.

Further, due to the tapered front portion of the bristles 32, when the lower jaw is opened at an angle relative to the upper jaw, and the toothbrush is held generally horizontally, the angle of the tapering complements the angle of the lower jaw, and the bristles can make more full contact with the teeth.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

I claim:

1. A toothbrush, comprising:

(a) an elongated head having a forward end and a rearward end, a handle an da neck connecting the rearward end of the head with the handle; said head having a longitudinal axis between the forward end and the rearward end; and (b) bristles connected to the head, said bristles including (1) a first plurality of bristles extending linearly as a row along the longitudinal axis of the head, a first portion of said first plurality-of bristles including bristles having a first height and being located in the row and having a first end beginning at the rearward end and an opposite second end spaced from the forward end of the head, (2) a second plurality of bristles, each bristle having a second height which is less than the first height, the second plurality of bristles being oriented as two rows of bristles, each row being located substantially parallel, outward and adjacent the first portion of the first plurality of bristles, and (3) a third plurality of bristles, a first portion of said third plurality of bristles having a third height which is less than the first and second heights, and being located in rows substantially parallel, outward and adjacent the second plurality of bristles, the third plurality of bristles extending substantially around the first and second pluralities of bristles, wherein a second portion of the first plurality of bristles includes bristles, each having a height less than the first height and at least as high as the third height, and said bristles of the second portion decrease in height from the highest to the lowest in the direction from the second end of the first portion row to adjacent the forward end of the head.

2. The toothbrush as recited in claim 1, wherein each of the bristles of the first plurality of bristles has a first diameter and each of the bristles of the second and third pluralities of bristles has a second diameter that is smaller than the first diameter.

3. The toothbrush as recited in claim 2, wherein each of the bristles of the first plurality of bristles has a first hardness and each of the bristles of the second and third pluralities of bristles has a second hardness which is less hard than the first hardness.

4. The toothbrush as recited in claim 3, wherein the first height is about 11 mm, the second height is about 9.5 mm and the third height is about 8 mm.

5. The toothbrush as recited in claim 4, wherein a second portion of the third plurality of bristles includes bristles having a height that is less than the third height.

6. The toothbrush as recited in claim 2, wherein a second portion of the third plurality of bristles includes bristles having a height that is less than the third height.

7. The toothbrush as recited in claim 2, wherein the first height is about 11 mm, the second height is about 9.5 mm and the third height is about 8 mm.

8. The toothbrush as recited in claim 7, wherein each of the bristles of the first plurality of bristles has a first hardness and each of the bristles of the second and third pluralities of bristles has a second hardness which is less hard than the first hardness.

9. The toothbrush as recited in claim 1, wherein each of the bristles of the first plurality of bristles has a first hardness and each of the bristles of the second and third pluralities of bristles has a second hardness which is less hard than the first hardness.

10. The toothbrush as recited in claim 9, wherein the first height is about 11 mm, the second height is about 9.5 mm and the third height is about 8 mm.

11. The toothbrush as recited in claim 1, wherein the first height is about 11 mm, the second height is about 9.5 mm and the third height is about 8 mm.

12. The toothbrush as recited in claim 11, wherein a second portion of the third plurality of bristles includes bristles having a height that is less than the third height.

13. The toothbrush as recited in claim 1, wherein a second portion of the third plurality of bristles includes bristles having a height that is less than the third height.

* * * * *